US010121447B2

(12) United States Patent
Ghosh et al.

(10) Patent No.: US 10,121,447 B2
(45) **Date of Patent: *Nov. 6, 2018**

(54) OPTIMIZED SCREEN BRIGHTNESS CONTROL USING MULTI-POINT LIGHT INTENSITY INPUT

(71) Applicant: International Business Machines Corporation, Armonk, NY (US)

(72) Inventors: Rahul Ghosh, Morrisville, NC (US); William R. LaRiccia, Verona, NJ (US); Ravi K. Muthukrishnan, Bangalore (IN); Aaron J. Quirk, Cary, NC (US); Xianjun Zhu, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/787,048

(22) Filed: Oct. 18, 2017

(65) Prior Publication Data

US 2018/0040292 A1 Feb. 8, 2018

Related U.S. Application Data

(63) Continuation of application No. 14/819,133, filed on Aug. 5, 2015, now Pat. No. 9,875,722.

(51) Int. Cl.
*G09G 3/00* (2006.01)
*G09G 5/00* (2006.01)

(52) U.S. Cl.
CPC ..... *G09G 5/003* (2013.01); *G09G 2320/0626* (2013.01); *G09G 2360/144* (2013.01)

(58) Field of Classification Search
CPC ..... G09G 5/003; G09G 2320/0626; G09G 2360/144
See application file for complete search history.

(56) References Cited

U.S. PATENT DOCUMENTS

2011/0282468 A1 11/2011 Ashdown
2013/0088523 A1 4/2013 Wu
(Continued)

FOREIGN PATENT DOCUMENTS

JP 5542409 7/2014
WO WO2015/199806 * 12/2015

OTHER PUBLICATIONS

"U.S. Appl. No. 14/819,133 Final Office Action", dated Jun. 23, 2017, 12 pages.

(Continued)

*Primary Examiner* — Aneeta Yodichkas
(74) *Attorney, Agent, or Firm* — DeLizio Law, PLLC

(57) ABSTRACT

This disclosure provides systems, methods, and apparatus, including computer programs encoded on computer-readable media, for controlling a display screen brightness level for an electronic device. In one embodiment, the electronic device determines a first ambient light level and associates the first ambient light level with a first priority weight value. The electronic device further determines a second ambient light level and associates the second ambient light level with a second priority weight value. A display controller within the electronic device sets the display screen brightness level based, at least in part, on the first ambient light level, the second ambient light level, and at least one of the first and second priority weight values.

20 Claims, 5 Drawing Sheets

(56) References Cited

U.S. PATENT DOCUMENTS

| | | | | |
|---|---|---|---|---|
| 2013/0120330 | A1 | 5/2013 | Kang et al. | |
| 2015/0134249 | A1 | 5/2015 | Yen | |
| 2016/0091877 | A1* | 3/2016 | Fullam | G05B 15/02 700/276 |
| 2016/0098973 | A1 | 4/2016 | Yang et al. | |
| 2016/0209903 | A1 | 7/2016 | Imana et al. | |
| 2016/0239190 | A1 | 8/2016 | Forutanpour et al. | |
| 2017/0039958 | A1 | 2/2017 | Ghosh et al. | |

OTHER PUBLICATIONS

"U.S. Appl. No. 14/886,959 FAI PreInterview Comm", dated Apr. 11, 2017, 5 pages.

* cited by examiner

OPTIMIZED SCREEN BRIGHTNESS CONTROL USING MULTI-POINT LIGHT INTENSITY INPUT

RELATED APPLICATIONS

This application is a continuation of and claims the priority benefit of U.S. application Ser. No. 14/819,133 filed Aug. 5, 2015.

BACKGROUND

Embodiments of the inventive subject matter generally relate to the field of adjusting display screen brightness, and more particularly, to adjusting display screen brightness based on multi-point light intensity analysis.

Display screens such as on mobile devices such as smartphones typically include a form of backlighting to enable users to perceive displayed content such as text and images. The effective visibility is determined by the contrasts effectuated by the display screen backlighting.

Dynamic brightness control is an important feature for balancing energy conservation and screen visibility for mobile devices such as smartphones. Since the display screen backlight is a primary consumer of electrical power (battery or power cord), it is generally desired for the backlight to be maintained at the minimal level required to provide adequate visual clarity for a user so that the backlight strength is balanced with the user's need to clearly discern display screen content. One approach to achieving this balance is to use an ambient light sensor on the mobile device to detect the current ambient light intensity and to adjust the screen brightness level (i.e., the backlight intensity) as a function of the detected ambient brightness.

SUMMARY

A method is disclosed for controlling a display screen brightness level for an electronic device. In one embodiment, the electronic device determines a first ambient light level and associates the first ambient light level with a first priority weight value. The electronic device further determines a second ambient light level and associates the second ambient light level with a second priority weight value. A display controller within the electronic device sets the display screen brightness level based, at least in part, on the first ambient light level, the second ambient light level, and at least one of the first and second priority weight values.

BRIEF DESCRIPTION OF THE DRAWINGS

The present embodiments may be better understood, and numerous objects, features, and advantages made apparent to those skilled in the art by referencing the accompanying drawings.

DESCRIPTION OF EMBODIMENT(S)

The description that follows includes example systems, methods, techniques, instruction sequences and computer program products that embody techniques of the present inventive subject matter. However, it is understood that the described embodiments may be practiced without these specific details. In other instances, well-known instruction instances, protocols, structures and techniques have not been shown in detail in order not to obfuscate the description.

As described and depicted in further detail with reference to the figures, embodiments are directed to providing a method, system, device, and program product for controlling levels of display screen brightness that account for multiple ambient light sensor inputs. In one embodiment, an electronic device such as a handheld mobile device or a laptop computer includes a display controller that receives ambient light input from at least two sources. For example, the electronic device may comprise an ambient light sensor that detects an ambient light level in radial proximity to the electronic device itself. The electronic device may be wirelessly connected to an external ambient light sensor that is incorporated onto a user wearable device, such as eyeglasses and/or a wristband. In an embodiment, the display controller is configured to associate priority weight values to sensed light levels received from each of the ambient light sensors. The priority weight values may include pre-specified default values that may be assigned by user application or otherwise pre-programmed. In an embodiment, the display controller normalizes the multiple received ambient light level values based on pre-programmed and/or dynamic system variables. The priority weight values may be dynamically adjusted based on respectively sensed ambient light levels and/or systemic or environmental factors. The normalized and weighted ambient light values may then be processed by the display controller to determine or adjust a display screen brightness level. The wearable device(s) onto which the external ambient light sensor is incorporated may be strategically selected to provide optimal, multi-point ambient light sensing coverage in a particular environment. The depicted embodiments therefore provides enhanced input options and processing and utilization of the multiple input options to optimize display screen brightness control.

Figure 1:
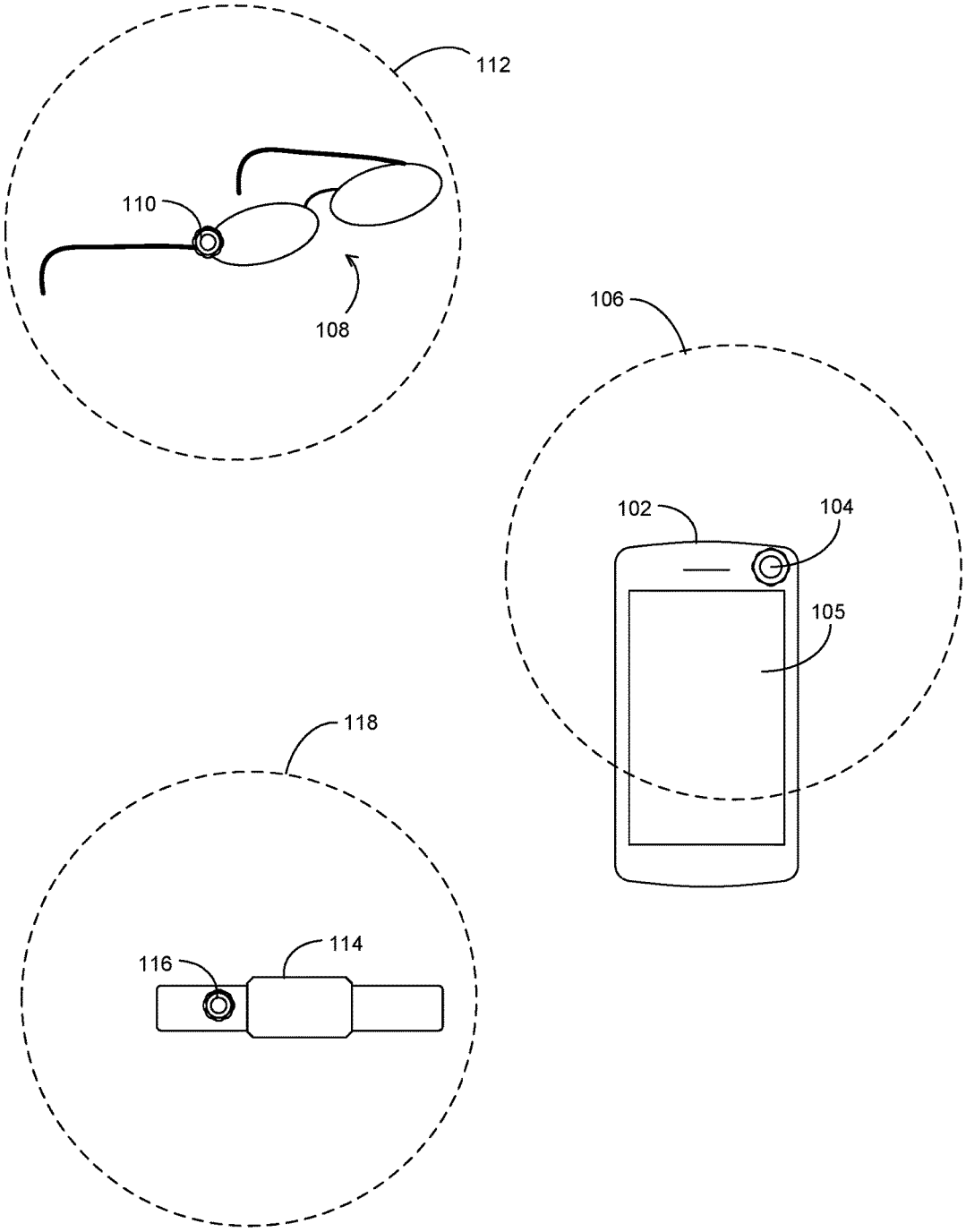
FIG. 1 depicts devices and components that may be utilized with a display screen brightness control system in accordance with an embodiment.

FIG. 1 depicts devices and components, including a handheld mobile device 102, that may be utilized with a display screen brightness control system in accordance with an embodiment. Mobile device 102 may be, for example, a smartphone comprising several features for receiving and processing information such as from a user input interface and/or from a network interface. Mobile device 102 typically comprises memory and processor components for storing and processing received information such as multimedia programs and data. Mobile device 102 further includes components and devices for displaying, transmitting, or otherwise outputting information and signals. For example, mobile device 102 comprises an input/output (I/O) display screen 105 on which images, such as text, video, and other graphic presentations, can be visually displayed. Display screen 105 may further display user selectable objects that can be used to receive user input to be processed by mobile device 102.

Figure 2:
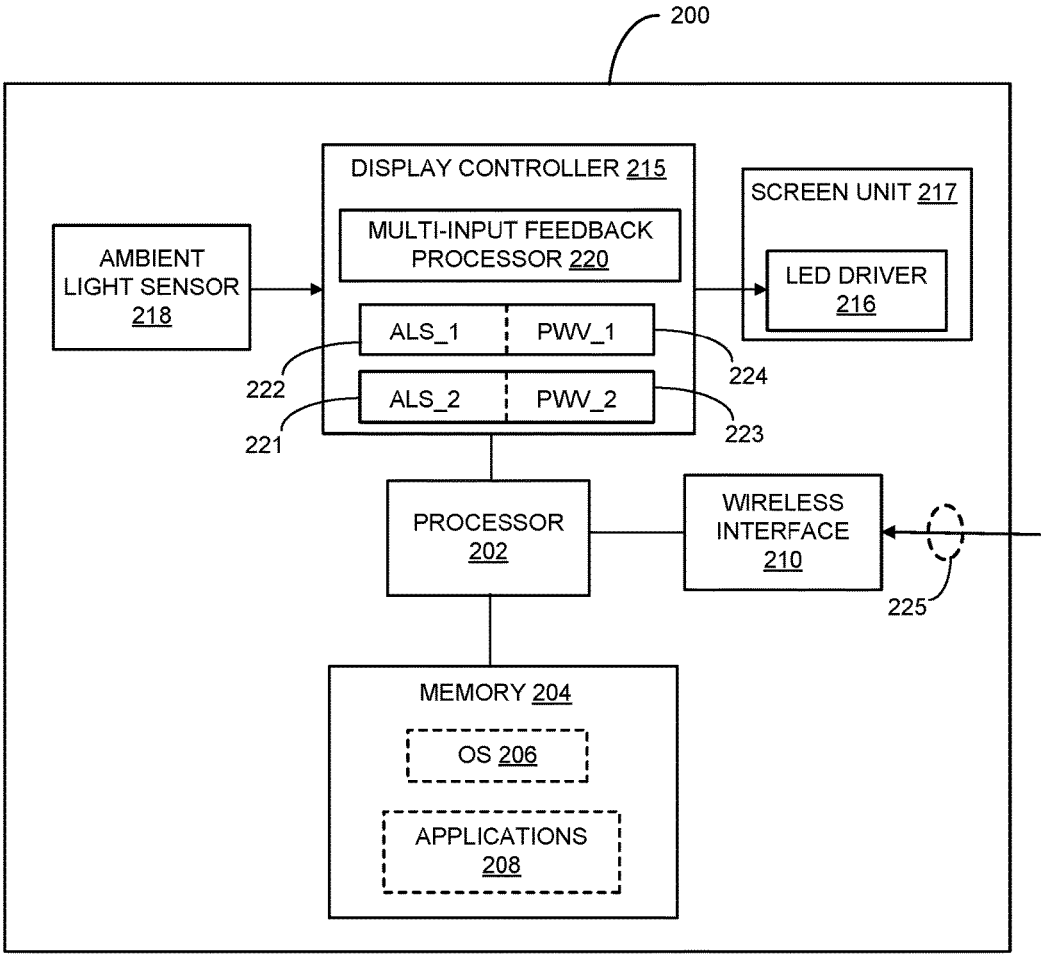
FIG. 2 is a schematic block diagram illustrating a mobile device in which a display screen brightness control system may be implemented in accordance with an embodiment.

Display screen 105 includes material and components for rendering visually perceptible images based on signals from a display controller (shown in FIG. 2). Display screen 105 includes or otherwise utilizes a source of illumination to facilitate image rendering. For example, display screen 105 may be a flat panel liquid-crystal display (LCD) that utilizes light modulating properties of liquid crystals. In this case, display screen 105 would comprise a number of segments filled with liquid crystals and arrayed in front of a light source (backlight) to produce color or monochrome images. The backlight is typically disposed behind a "glass stack." Whether display screen 105 is a direct light screen (e.g., cathode ray tube) or a screen panel that itself does not emit light (e.g., LCD screen illuminated by a backlight), the intensity of the illumination source may be referred herein to as "screen brightness" or "screen brightness level."

In the depicted embodiment, mobile device 102 further includes an ambient light sensor 104 that detects lights levels in a radial area 106 proximate to mobile device 102. Ambient light sensor 104 may include, for example, a photodetector that detects levels of and/or variations in levels of ambient luminescence such as may be sensed/detected in terms of illuminance (lux). As depicted and described in further detail with reference to FIG. 2, mobile device 102 further comprises hardware and/or software components and logic that control the screen brightness level of display screen 105 based, at least in part, on ambient light detected by ambient light sensor 104. The brightness control components utilize input from ambient light sensor 104 to optimize displayed image quality in terms of optical perceptibility. For example the brightness control components may increase or decrease screen brightness depending on the currently sensed level of ambient lighting, which may vary considerably. Also, the brightness control components may be configured to adjust screen brightness based on energy conservation parameters, such as to reduce battery energy draw while still maintaining adequate user viewability. For example, if light sensor 104 detects a relatively low light level in the radial area 106 surrounding mobile device 102, the screen brightness control components may respond by dimming the screen brightness level to both save energy and reduce eye strain. When the detected ambient light level is higher, the brightness control components may increase the screen brightness due to perceived glare (light reflected from the screen surface) which "washes out" the displayed image, and also because a user's optical light sensitivity may decrease as the ambient light level increases.

The input from ambient light sensor 104 may be processed to improve display viewability and/or reduce energy consumption. However, the detection range is directional and limited to the radial area proximate to where it is mounted on mobile device 102. For example, if ambient light sensor 104 is mounted substantially co-planar to display screen 105 (such that the sensor is facing the user's eyes when in use), the light sensor is limited to primarily measuring ambient luminescence originating from behind a user which is helpful to determine a potential glare effect and adjust display functions, including screen brightness, accordingly. However, the display side mounted sensor would have limited sensitivity to ambient light levels originating from behind and/or the sides of mobile device 102, which may substantially determine the user's optical sensitivity.

In an embodiment, a display screen brightness control system further includes at least one additional ambient light sensor that is positioned separately from a host electronic device on which the subject display screen is mounted. For example, FIG. 1 further depicts external light sensors coupled to or otherwise integrated with wearable devices such as eyeglasses 108 and a wristband 114. As shown in FIG. 1, external ambient light sensors 110 and 116 are respectively coupled to eyeglasses 108 and wristband 114 either of which or both may be wearable electronic devices that, like mobile device 102, may include a processor, memory, and a short range communication interface. Wearable devices, such as wearable devices 108 and 114, may be classified in one respect as a type of electronic device having a form factor suitable for being attached in some manner to a user. For example, wearable devices may be form factored to be fastened to, adhered to, hung onto, or otherwise fixedly attached to an article of clothing or a part of a user's body such as a wrist, ankle, ear, etc. Other significant features common to wearable computing devices include relatively continuous active operation and a form factor enabling continuous and uninterrupted access to and usage of the device by the user. Examples of wearable device form factors include those similar to eyeglasses or a wristbands. Wearable devices may be used for general or special purpose processing and communication activities that require more complex computational support than pre-coded hardware logic alone.

External light sensor 110 may be an ambient light sensor such as a photodetector that detects light levels within a radial area 112 proximate to eyeglasses 108. Furthermore, light sensor 110 may be communicatively coupled to mobile device 102 via a short-range RF connection such as Bluetooth®. When eyeglasses 108 are worn by a user holding mobile device 102, ambient light sensor 110 is positioned proximate to the user's eye level. Therefore, when activated, ambient light sensor 110 detects light level values which are transmitted to mobile device 102 to be processed in combination with light level values sensed locally by ambient light sensor 104.

External light sensor 116 may be an ambient light sensor such as a photodetector that detects light levels within a radial area 118 proximate to wristband 114 and may be communicatively coupled to mobile device 102 via a short-range RF connection such as Bluetooth®. When wristband 114 is worn on one of the user's wrists (of the handling holding mobile device 102 or the other hand), ambient light sensor 116 provides an alternate position and angle for light level detection. When activated, ambient light sensor 116 detects light level values which are transmitted to mobile device 102 to be processed in combination with light level values sensed locally by ambient light sensor 104 and/or external ambient light sensor 110.

Mobile device 102 may further include components and logic for setting a screen brightness level (e.g., adjusting the luminous output of a screen light or backlight) based on multiple input light levels, such as from ambient light sensors 104, 110, and/or 116. Furthermore, and as depicted and described in further detail with reference to FIG. 2, a mobile device, such as mobile device 102, may further include components and logic for setting a screen brightness level based on multiple input light levels and priority weight values associated with one or more of the multiple sensed light level inputs.

FIG. 2 is a schematic block diagram illustrating a mobile device 200 in which a display screen brightness control system may be implemented in accordance with an embodiment. Mobile device 200 may be a smartphone or other handheld communication and processing device that displays data and graphics on a display screen having an illumination and/or backlight source. Mobile device 200 comprises components and devices including a host processor 202 and a system memory 204 which cooperatively function to manage various system-level and application-level programs and data that enable device 200 to perform various data input/output (I/O), signaling, and processing tasks associated with data display including video and/or multimedia applications.

System memory 204 stores application programs 208, as well as system programs and supporting data that control operations of device 200. The system software stored within system memory 204 includes an operating system (OS) 206 that coordinates activities among hardware components and utility program software that performs system management tasks. OS 206 may be a flexible, multi-purpose OS such as the Android OS found in smartphones, or may be an embedded OS having more specialized functions such as may loaded within a minimal form factor audio device. OS 206 generally comprises code for managing and providing services to hardware and software components within device 200 to enable program execution. Among other code and instructions, OS 206 includes process management code comprising instructions for interfacing application code with system hardware and software. OS 206 may further include memory management code for allocating and managing memory for use by application and system-level programs. OS 206 further includes I/O system management code including device drivers that enable the system's hardware to communication with external computer systems.

Mobile device 200 further comprises a display controller 215, which may be a microcontroller that interfaces a display screen unit 217 with the host processor 202 and generally controls display screen functions. Mobile device 200 also includes a screen brightness control system comprising ambient light input components, ambient light data processing components, and screen brightness actuator components. The ambient light input components comprise an ambient light sensor 218 and an external ambient light input 225. The ambient light data processing components include multi-input feedback processor 220 within display controller 215. Feedback processor 220 may comprise components and logic configured to process sensed ambient light levels from multiple sensors including local ambient light sensor 218 and from external ambient light input 225. The screen brightness actuator components include an LED driver unit 216 that controls the current flow through one or more backlights (not depicted) within display screen unit 217.

In an embodiment, sets of special purpose registers may be allocated within display controller 215 to store ambient light levels (e.g., quantified values indicated an amount or intensity of received light) from multiple input sources. As depicted in FIG. 2, display controller 215 includes a register 222 configured to receive and stored light level values obtained from ambient light source, ALS_1. The ALS_1 content of register 222 is logically associated with a priority weight value, PWV_1, contained in a register 224. Display controller 215 includes an additional ambient light input register 221 configured to receive and store light level values ALS_2, obtained from a second ambient light sensor source. For example, the first ambient light source value, ALS_1, may be obtained from local ambient light sensor 218 and the second ambient light level value, ALS_2, may be obtained from an external sensor via input 225. Similarly, the ALS_2 content of register 221 is logically associated with a priority weight value, PWV_2, stored in a register 223. As depicted and described with reference to FIGS. 3 and 4, the light level values are processed, including being weighted in accordance with the associated priority weight levels, and utilized by display controller 215 to determine an optimal screen brightness level.

Figure 3:
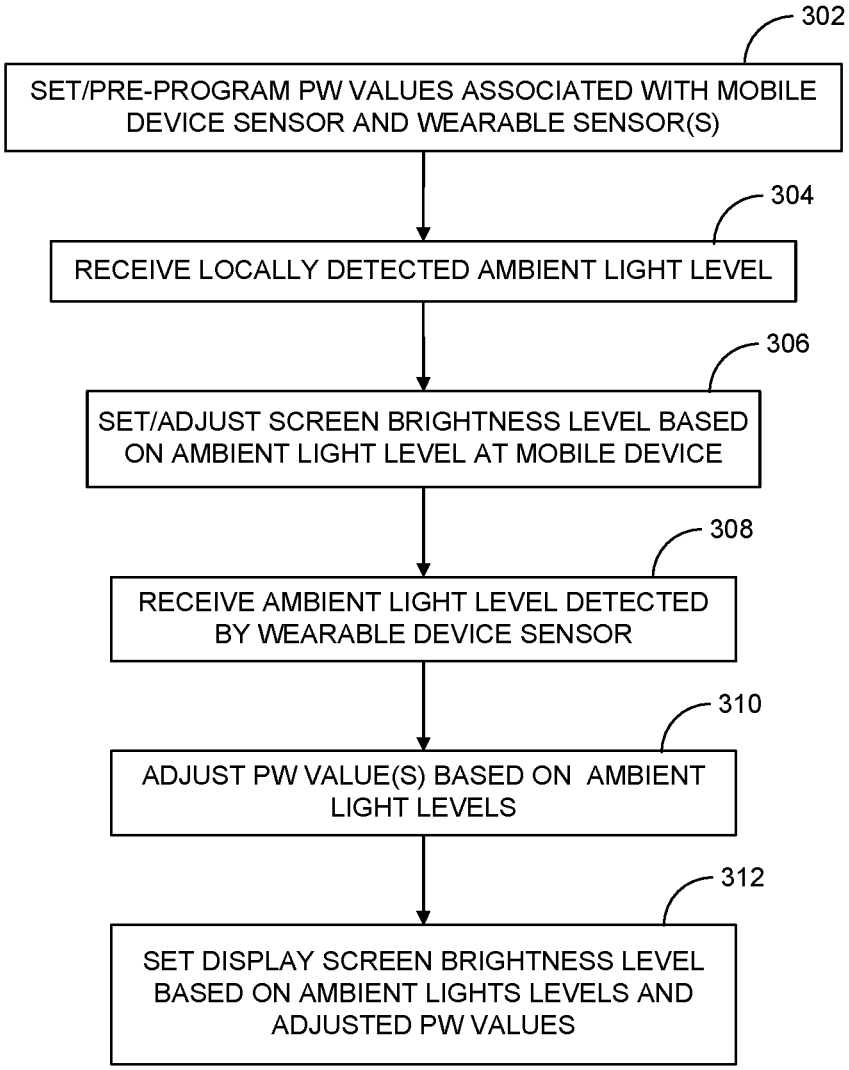
FIG. 3 is a flow diagram depicting operations and functions performed during display screen brightness control in accordance with an embodiment.

FIG. 3 is a flow diagram depicting operations and functions performed by an electronic device during display screen brightness control in accordance with an embodiment. One or more of the operations and functions depicted in FIG. 3 may be performed by the mobile device 200 shown in FIG. 2. The process begins as shown at step 302 with the setting of priority weight values to be associated with each of one or more input light level values received from one or more respective ambient light sensors. For example, a default priority weight value may be assigned to sensor inputs received from a local sensor (e.g., ambient light sensor 218 in FIG. 2) and to sensor inputs received from an external sensor (e.g., ambient light sensor input received via input 225). The default value may be overridden at step 302 such as by user input that assigns a different value to either or all of the default values.

Once activated, the screen brightness control portion of the display system begins receiving light level input data from the local ambient light sensor (step 304) and processes the data to set and/or adjust the screen brightness level accordingly as shown at step 306. The detection and processing of local light levels may be performed periodically or substantially continuously. Regardless of the frequency of light level detection, the display controller may dependently or independently determine the frequency with which the screen brightness is adjusted in accordance with programmed parameters. In addition to receiving locally detected light levels, the display controller receives light level values detected by external sensors (step 308), such as ambient light sensors 110 and 116 in FIG. 1.

In an embodiment, the screen brightness control portion of the display controller utilizes the light level data received from at least two of the ambient light sensors and the respectively associated priority weight values to set and/or adjust the display screen brightness. As part of the setting/adjustment process, and as shown at step 310, the display controller may adjust one or more of the priority weight values associated with the received light level values. As depicted and described in further detail with reference to FIG. 4, the priority weight values may be adjusted based on differences in the received light level values. The process continues as shown at step 312 with the display controller 215 setting/adjusting the screen brightness level based on the light level values weighted in accordance with the respective priority weight values. In one embodiment, and depicted and described with reference to FIG. 4, the weighted light level values may be combined to generate an aggregate ambient light level value that may be processed by display controller 215 to select and transmit corresponding brightness adjustment signals to a screen brightness actuator, such as LED driver 216 in FIG. 2.

Figure 4:
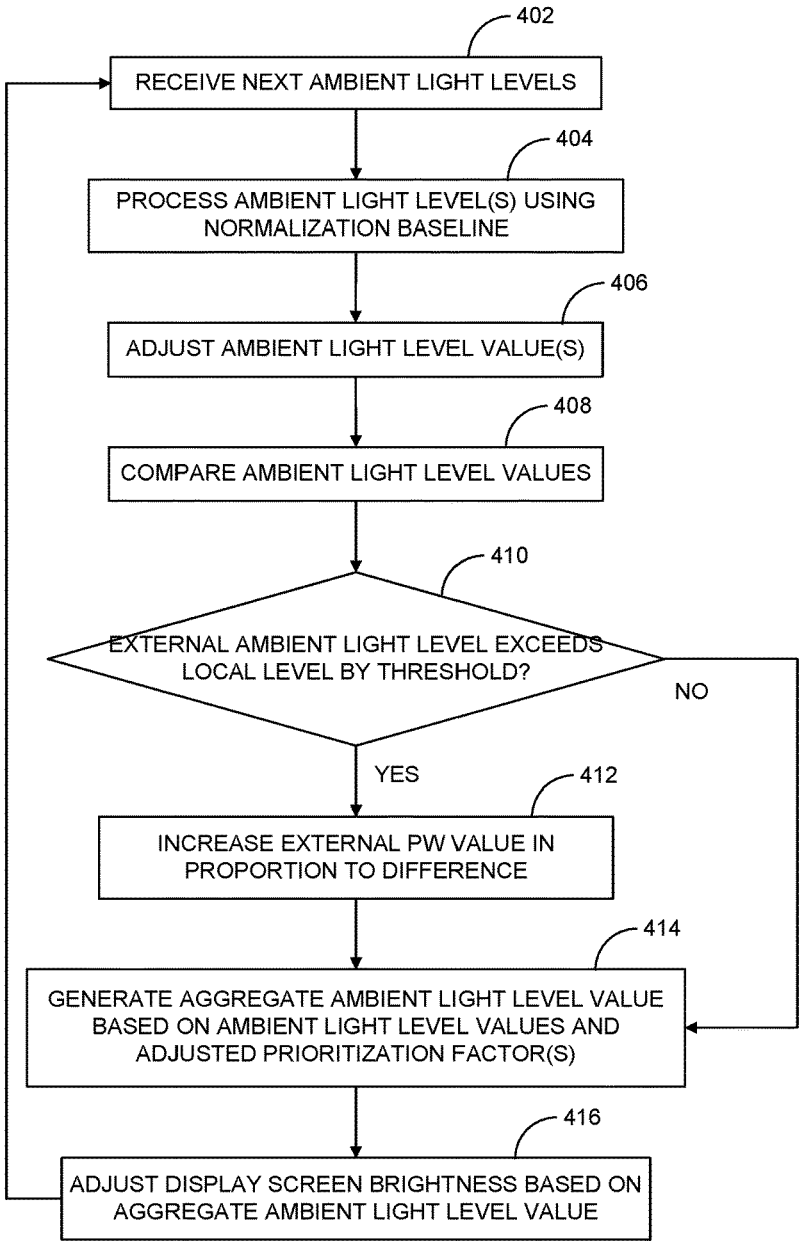
FIG. 4 is a flow diagram illustrating operations and functions performed during setting and adjustment of display screen brightness in accordance with an embodiment.

FIG. 4 is a flow diagram illustrating more operations and functions performed during steps 310 and 312 of FIG. 3 to set and adjust display screen brightness in accordance with an embodiment. The operations and functions may be performed by an electronic device, such as mobile device 200, which includes components and logic configured to determine an aggregate light level from the multiple inputs and utilize that aggregate to set and adjust screen brightness level. The process begins with the display screen brightness having been set/adjusted based on local sensor light level input and continues as shown at step 402 with a display controller receiving a next set of light level values from one or more ambient light sensors. Each of the ambient light sensors may have different design and/or implementation characteristics resulting in greater or lesser sensitivity. To account for variations in design and relative disposition, multi-input processing logic such as within a display controller may access a normalization baseline to normalize the ambient light level values received from at least two of the sensors (steps 404 and 406).

The process continues as shown at step 408 with the display controller comparing two or more of the received and normalized ambient light level values to determine environmental lighting conditions with respect to relative positioning of the light sensors. For example, the display controller may compare a level light value originally received from the local sensor and a light level originally received from an external sensor to determine whether, based on the difference, the prioritization weight values associated with one or both light level values should be adjusted. For example, and as shown at steps 410 and 412, if the external ambient light level exceeds the locally sensed level, the priority weight factor associated with the external light level may be increased. The increase may be a predetermined increment or may be in proportion to the magnitude of the difference between the light levels. Following adjustment of the priority weight value(s) or in response to determining that the difference between the locally sensed light level value and an externally sensed value does not exceed a specified threshold, the process continues as shown at steps 414 with the multi-input brightness control logic generating an aggregate light level value. In one embodiment, the aggregate value comprises a weighted average of two or more of the light level values weighted in accordance with the associated priority weight values. The display controller then signals a screen brightness actuator to adjust the screen brightness level based on the aggregate light level value as shown at step 416 following which the process may resume at step 402.

Figure 5:
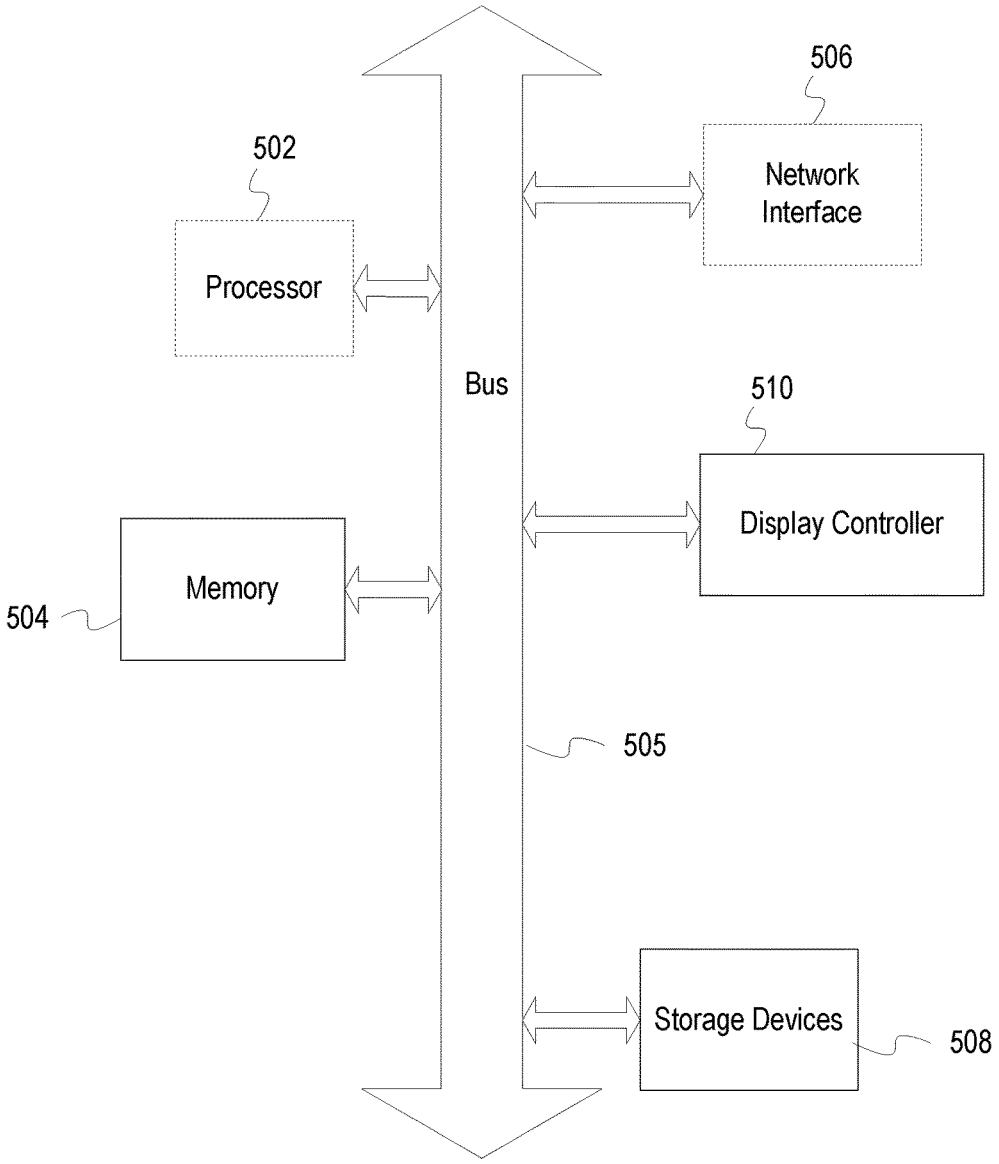
FIG. 5 is a block diagram of a computer system for performing the functions described and depicted with reference to FIGS. 1-4.

FIG. 5 depicts an example computer system that includes a display controller 510. The computer system includes a processor 502 (possibly including multiple processors, multiple cores, multiple nodes, and/or implementing multithreading, etc.). The computer system includes memory 504 which may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes an interconnect 505 (e.g., PCI, ISA, PCI-Express, HyperTransport®, InfiniBand®, NuBus, etc.), a network interface 506 (e.g., an Ethernet interface, a Frame Relay interface, SONET interface, wireless interface, etc.), and a storage device(s) 508 (e.g., optical storage, magnetic storage, etc.). Display controller 510 embodies functionality to implement features described above with reference to FIGS. 1-4. Display controller 510 may perform operations for adjusting display screen brightness. Any one of these functionalities may be partially (or entirely) implemented in hardware and/or on processor 502. For example, the functionality may be implemented with an application specific integrated circuit, in logic implemented in processor 502, in a co-processor on a peripheral device or card, etc. Further, realizations may include fewer or additional components not illustrated in FIG. 5 (e.g., additional network interfaces, peripheral devices, etc.).

As will be appreciated by one skilled in the art, aspects of the present inventive subject matter may be embodied as a system, method or computer program product. Accordingly, aspects of the present inventive subject matter may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present inventive subject matter may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Aspects of the present inventive subject matter are described with reference to flowchart illustrations and/or block diagrams of methods, apparatus (systems) and computer program products according to embodiments of the inventive subject matter. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

What is claimed is:

1. A method performed by a first device for controlling a display screen brightness level, the method comprising:

determining a first ambient light level at a first light sensor of the first device;

determining a second ambient light level at a second light sensor of a second device that is different from the first device; and setting the display screen brightness level of a display in the first device based, at least in part, on the first ambient light level and the second ambient light level.

2. The method of claim 1, wherein the second device is a wearable device that is associated with the first device.

3. The method of claim 2, wherein the first device is a handheld mobile device that is communicatively coupled with the wearable device.

4. The method of claim 1, wherein said setting the display screen brightness level comprises:

determining a normalization baseline for at least one of the first and second ambient light levels; and normalizing at least one of the first and second ambient light levels based on the normalization baseline.

5. The method of claim 1, wherein the first ambient light level is associated with a first priority weight value, wherein the second ambient light level is associated with a second priority weight value, and wherein the display screen brightness level is further based, at least in part, on the first and second priority weight values.

6. The method of claim 5, wherein said setting the display screen brightness level comprises:

generating an aggregate ambient light level value based on the first and second ambient light levels and the first and second priority weight values; and sending the aggregate ambient light level value to a display feedback controller within the first device.

7. The method of claim 5, wherein said setting the display screen brightness level comprises:

comparing the first and second ambient light levels; and adjusting the second priority weight value in response to determining that the second ambient light level exceeds the first ambient light level by a threshold amount.

8. The method of claim 7, wherein said adjusting the second priority weight value comprises increasing the second priority weight value in proportion to a difference between the first and second ambient light levels.

9. The method of claim 1, wherein the first device is communicatively coupled with the second device, and wherein said determining the second ambient light level comprises receiving from the second device, the second ambient light level detected by the second light sensor.

10. The method of claim 1, further comprising:

determining a third ambient light level at a third light sensor of a third device that is different from the first device; and setting the display screen brightness level of the display in the first device based, at least in part, on the first ambient light level, the second ambient light level, and the third ambient light level.

11. A wearable device, comprising:

a light sensor;

a processor; and memory storing instructions which, when executed by the processor, cause the wearable device to:

detect an ambient light level at the light sensor of the wearable device; and cause a first device to adjust a display screen brightness level of a display integrated into the first device based, at least in part, on the ambient light level at the light sensor of the wearable device, wherein the first device is separate from the wearable device.

12. The wearable device of claim 11, further comprising:

a short-range radio frequency communication interface configured to communicate with the first device, wherein the instructions to cause the first device to adjust the display screen brightness level include instructions which, when executed by the processor, cause the wearable device to:

send an indication of the ambient light level to the first device via the short-range radio frequency communication interface of the wearable device.

13. The wearable device of claim 11, wherein a form factor of the wearable device is designed such that the wearable device can be fastened to, adhered to, hung onto, or attached to an article of clothing.

14. The wearable device of claim 11, wherein a form factor of the wearable device is designed such that the wearable device can be worn on a face, wrist, ankle, or ear of a body.

15. The wearable device of claim 11, wherein the wearable device is an accessory that is communicatively coupled to the first device.

16. A method performed by a wearable device, the method comprising:

detecting an ambient light level at a light sensor of the wearable device; and causing, by the wearable device, a first device to adjust a display screen brightness level of a display in the first device based, at least in part, on the ambient light level at the light sensor of the wearable device, wherein the first device is separate from the wearable device.

17. The method of claim 16, wherein causing the first device to adjust the display screen brightness level comprises:

sending an indication of the ambient light level to the first device via a communication interface of the wearable device.

18. The method of claim 17, wherein the communication interface comprises a short-range radio-frequency wireless communication interface.

19. The method of claim 16, wherein a design of the wearable device is such that the light sensor of the wearable device is positioned to detect the ambient light level of light originating from behind or sides of the first device when the display of the first device is facing a user.

20. The method of claim 16, wherein the wearable device comprises eyeglasses or a wristband.

* * * * *